US007025502B2

(12) United States Patent
Freudenberger et al.

(10) Patent No.: US 7,025,502 B2
(45) Date of Patent: Apr. 11, 2006

(54) APPARATUS WITH A ROTATIONALLY DRIVEN BODY IN A FLUID-FILLED HOUSING

(75) Inventors: Jörg Freudenberger, Baiersdorf (DE); Peter Schardt, Höchstadt A.D.Aisch (DE)

(73) Assignee: Siemens Aktiengesellschaft, Munich (DE)

( * ) Notice: Subject to any disclaimer, the term of this patent is extended or adjusted under 35 U.S.C. 154(b) by 120 days.

(21) Appl. No.: 10/841,151

(22) Filed: May 7, 2004

(65) Prior Publication Data

US 2004/0264645 A1 Dec. 30, 2004

(30) Foreign Application Priority Data

May 7, 2003 (DE) ..... 103 20 361

(51) Int. Cl.
*H01J 35/12* (2006.01)

(52) U.S. Cl. ..... 378/200; 378/141; 378/130

(58) Field of Classification Search ..... 378/200, 378/199, 144, 141, 131, 130, 125, 121, 119
See application file for complete search history.

(56) References Cited

U.S. PATENT DOCUMENTS

| | | | | |
|---|---|---|---|---|
| 5,703,926 | A | 12/1997 | Bischof | 378/200 |
| 6,213,639 | B1 | 4/2001 | Hell et al. | 378/200 |
| 6,364,527 | B1 | 4/2002 | Kutschera | 378/207 |
| 6,396,901 | B1 * | 5/2002 | Hell et al. | 378/130 |
| 2005/0025282 | A1 * | 2/2005 | Freudenberger et al. | 378/119 |

FOREIGN PATENT DOCUMENTS

DE 8713042.41 3/1989

* cited by examiner

*Primary Examiner*—Edward J. Glick
*Assistant Examiner*—Courtney Thomas
(74) *Attorney, Agent, or Firm*—Schiff Hardin LLP

(57) ABSTRACT

To reduce the rotational power, an apparatus with a rotational body that is rotationally driven in a fluid-filled housing a rotational directing body is provided between the rotational body and the housing, which is rotatably supported coaxially with respect to the rotational body. The rotational directing body is configured such that in operation it rotates at an intermediate rotational frequency in comparison to the housing and the rotational body. The apparatus is particularly an X-ray radiator having a cathode and anode that are mounted in a vacuum tube in a spatially fixed manner in relation to the tube, the vacuum tube being rotationally driven as a rotational body in a coolant housing.

14 Claims, 2 Drawing Sheets

APPARATUS WITH A ROTATIONALLY DRIVEN BODY IN A FLUID-FILLED HOUSING

BACKGROUND OF THE INVENTION

1. Field of the Invention

The present invention relates to an apparatus with a rotational body that is rotationally driven in a fluid-filled housing. The invention relates especially to an X-ray radiator of the type having a cathode and anode that are mounted in a vacuum tube in a spatially fixed manner in relation to the vacuum tube, the vacuum tube being rotatably supported as a rotational body in a coolant housing, and having a stationary deflection system for lateral deflection of an electron beam directed from the cathode to the anode. An X-ray radiator of this type is normally designated as a "rotating piston radiator".

2. Description of the Prior Art

X-ray radiation is normally generated by striking an anode with an electron beam emanating from a cathode. The cathode and the anode are mounted in a vacuum tube. Normally, an X-ray radiator is equipped nowadays with an anode that rotates under the incident electron beam in order to avoid a stationary focal spot relative to the anode. The focal spot, i.e., the point at which the electron beam strikes on the anode surface, is displaced, from the viewpoint of a coordinate system rotating with the anode, along a circular path over the anode surface. In this manner, the heat produced upon incidence of the electron beam is distributed comparatively uniformly on the anode surface, so material overheating in the cathode spot is counteracted.

In a "rotating piston radiator" of this type, the cathode and the anode are joined in a rotationally fixed manner to the vacuum tube and are rotated along with it. Here, the relative movement of the focal spot with respect to the anode surface is produced by the electron beam being deflected along a spatially fixed lateral direction out of the rotational axis of the vacuum tube, and thus it strikes the anode at a distance from the rotational axis of the rotating anode.

An X-ray radiator of the type described above is known, for example, from German Utility Model 87 13 042. The vacuum tube of this known X-ray radiator is surrounded by a protective housing filled with insulating oil and is rotatably supported therein around its center axis. The insulating oil (which acts simultaneously as a coolant) flows through the protective housing and thus enables a dissipation of the heat that arises during the operation of the X-ray radiator. A disadvantage of this known X-ray radiator is the friction losses of the coolant that is put into rotation as the vacuum tube rotates. To compensate for these friction losses, a drive power, which is not insignificant, is required which is mostly converted in a wasteful manner into heat and an acceleration of the coolant.

In order to reduce the friction losses within the coolant, in X-ray radiators known from U.S. Pat. No. 6,364,527 and U.S. Pat. No. 5,703,926, the vacuum tube is accommodated in a coolant housing which is rotated along with the vacuum tube. Due to the fact that the vacuum tube, the coolant housing as well as the coolant disposed therebetween rotate at the same or a similar angular speed, the friction loss within the coolant is reduced to a small level. A coolant container that rotates along with the vacuum tube, however, can be implemented only in a comparatively expensive manner, particularly since it must be provided with sealed bearings. Moreover, there is a disadvantage that, due to the rotating coolant housing, additional centrifugal forces arise which can counteract a fast rotation of the vacuum tube.

U.S. Pat. No. 6,213,639 discloses an X-ray radiator having a cathode and anode that are mounted in a vacuum tube in a spatially fixed manner in relation to the tube wherein the vacuum tube is rotationally driven in a coolant housing and a stationary deflection system is provided for lateral deflection of an electron beam directed from the cathode to the anode. Between the vacuum tube and the coolant housing, a coolant directing body attached on the coolant housing is provided.

The above-described problem is not limited to X-ray radiators. An undesired friction loss of the described type occurs in every rotational body driven in a fluid bath. Rotational bodies of this type are used, for example, in turbine technology, drive technology and cooling technology.

SUMMARY OF THE INVENTION

An object of the present invention is to provide an apparatus with a rotational body that is rotatably supported is a fluid-filled housing which enables exploitation of the rotational power with particularly low loss. A further object of the invention is to provide an improved rotating piston radiator, i.e., an X-ray radiator having a cathode and anode that are mounted in a vacuum tube in a spatially fixed manner in relation to the tube, the vacuum tube being rotatably supported in a coolant housing, and having a stationary deflection system for lateral deflection of an electron beam directed from the cathode to the anode being provided.

With respect to the X-ray radiator, the above object is achieved according to the invention by an x-ray radiator of the type described above wherein between the rotational body (which in the case of the X-ray radiator is formed by the vacuum tube) and the housing (which in the case of the X-ray radiator is formed by the coolant housing), a rotational directing body is rotatably supported coaxially with respect to the rotational body. The rotational directing body is formed such that during the operation of the apparatus, particularly the X-ray radiator, it rotates at an intermediate rotational frequency, i.e., a rotational frequency that lies between the rotational frequency of the rotational body and the rotational frequency of the housing. The invention also relates to an apparatus with a stationary housing. A stationary housing can be considered as a housing that rotates at a rotational frequency of zero.

As used herein a "rotational directing body" means a body that is rotatably supported and entirely surrounded by a fluid so that the body influences the flow behavior of the fluid.

The invention proceeds from the recognition that the friction loss that occurs in a fluid is dependent significantly on the relative speed of the walls which delimit the fluid. In a rotational body that is rotationally driven in a housing, this relative speed is proportional to the relative rotational frequency of the rotational body with respect to the housing. Here, the friction loss occurring in the fluid becomes larger as the relative rotational frequency of the rotational body with respect to the housing becomes larger. As can be verified theoretically and empirically, the relationship between the rotational power P required to rotate the rotational body at a specified rotational frequency f and the rotational frequency f is nonlinear and exhibits a cubic dependency $P \sim f^3$. The latter relationship holds under the assumption that when the rotational body is rotated, a turbulent flow is produced in the fluid. This is fulfilled particularly for a typical X-ray radiator with a vacuum tube having a length of approx. 200 mm and an average diameter of approx. 120 mm, which rotates at an average rotational frequency of 150 Hz in a fluid formed by insulating oil. Recognizably, due to the cubic dependency, the rotational power decreases super-proportionally in case of a decrease in the relative rotational frequency.

Due to the rotational directing body between the rotational body and the housing rotating at an intermediate rotational frequency in accordance with the invention, the liquid located in the housing is separated into a region between the rotational body and the rotational directing body and a region between the rotational directing body and the housing. The lost power that occurs in each of the two fluid regions is now determined by the relative frequency of the rotational body with respect to the rotational directing body, or the relative frequency of the rotational directing body with respect to the housing. As a result of the super-proportional dependency of the rotational power on the relative frequency, the total of the power losses occurring in the two liquid regions is less than the power loss that would occur without the rotational directing body for the same rotational frequency of the rotational body with respect to the housing. The net rotational power thus is reduced considerably by the rotational directing body. The use of the rotational directing body represents a simple way in terms of design to reduce the rotational power. A particular advantage to that is no sealed bearings are required.

In an embodiment that is very simple in design, the rotational directing body is supported in a force-free manner, i.e., in a freely rotatable manner except for an unavoidable bearing friction. The rotation of the rotational directing body at an intermediate rotational frequency occurs due to the rotational body being rotated automatically under the influence of the liquid friction. Alternatively, a forced drive can be provided for the rotational directing body that drives it at a freely selectable intermediate rotational frequency. The rotational body and the rotational directing body could be suitably driven for this purpose by a common mechanism.

The rotational directing body can have a tube-shaped casing enclosing the exterior of the rotational body at a distance therefrom. As used herein, a body is designated as "tube-shaped" that is rotationally symmetrical and hollow, particularly having thin walls. Here, the casing can have a diameter that is constant or varying in the axial direction. In this manner, the liquid regions arranged in the radial direction on the near side and far side of the rotational directing body are fully separated from one another, which prevents a loss-promoting exchange of liquid between these regions.

For a design simplification, the rotational directing body can be supported in the axial direction on both sides of the rotational body on its axis.

In an embodiment which is particularly favorable in terms of fluid dynamics, the radial distance of the rotational directing body from the rotational body and/or the radial distance of the housing from the rotational directing body is small with respect to the radius of the rotational body and the radius of the rotational directing body. In both cases, the thickness of the respective fluid layer is small with respect to the radius of the rotational body or rather the rotational directing body. The respective radial distance can be constant or varying in the axial direction.

For a particularly reduced rotational power, a number of rotational directing bodies can be provided which are rotatably supported coaxially and at a spacing with respect to one another in the housing. These rotational directing bodies are either rotatably supported freely and independently of one another, or forcibly driven at respectively different rotational frequencies so that each rotational directing body in operation rotates at a rotational frequency which is intermediate with respect to the rotational frequency of the next rotational directing body inside or, if no such inside rotational body is present, the rotational body and the rotational frequency of the next rotational directing body outside, or if no such outside rotational body is present, the housing. In other words, the rotational frequencies of the rotational body, the successive rotational directing bodies and the housing behave strictly monotonically in the mathematical sense with respect to one another. For a stationary housing, the rotational frequency of the rotational directing bodies thus increases inwardly. The more rotational directing bodies the apparatus has, the lower the relative frequency of the adjacent bodies with respect to one another for the same rotational frequency of the rotational body. As a result of the nonlinear relationship of the power loss in the liquid with respect to the relative rotational frequency, a decrease in the power loss results.

The apparatus is in particular an X-ray radiator. Here, the rotational directing body preferably contains at least in one subregion, a radiation protection material, i.e., a material that greatly attenuates X-ray radiation, particularly lead. In this manner, a particularly compact implementation of the X-ray radiator is achieved that guarantees good protection against undesired radiation escape at the same time.

Among the benefits achieved with the invention are that in a rotating piston radiator, the rotational power is significantly reduced, and simultaneously during rotation of the vacuum tube a turbulent coolant flow is produced that causes efficient cooling by flowing around the anode.

DESCRIPTION OF THE PREFERRED EMBODIMENTS

Figure 1:
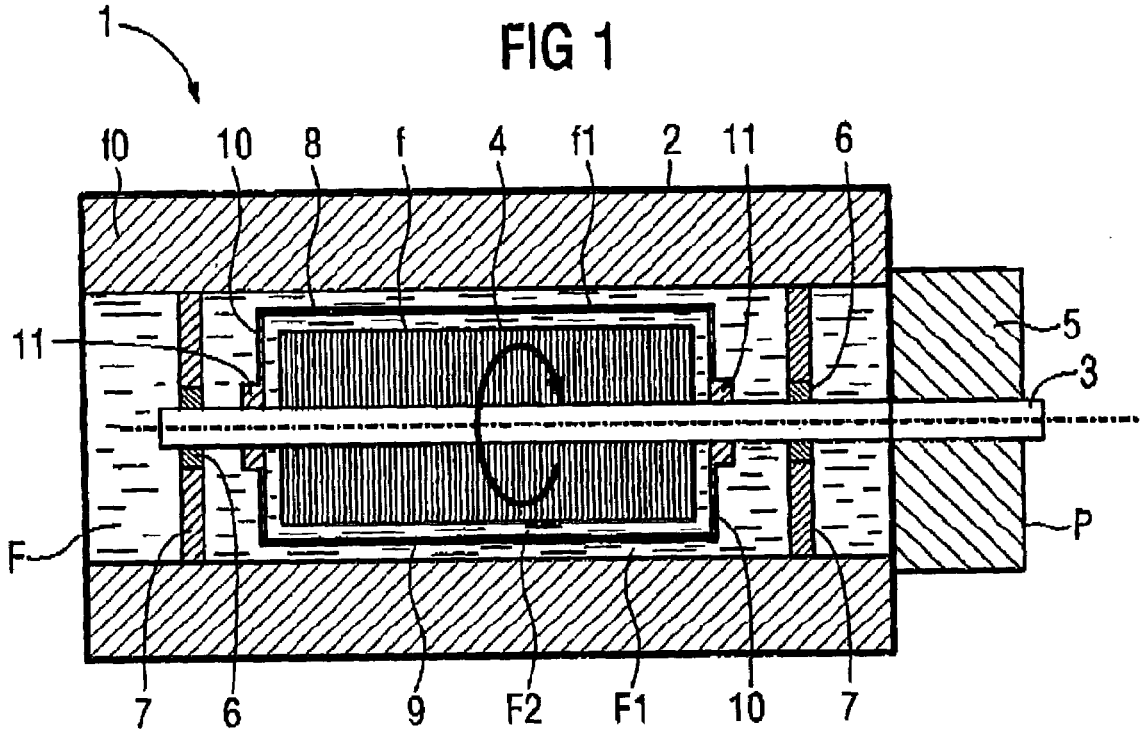
FIG. 1 is a schematic longitudinal section of an apparatus with a rotational body that is rotationally driven in a fluid-filled housing and a rotational directing body that is rotatably supported coaxially with respect to the rotational body, in accordance with the invention.

The apparatus 1 shown in FIG. 1 in a schematic representation includes a stationary housing 2 filled with a fluid F in which housing 2 a rotational body 4 that is rotatable about an axis 3 is supported. The rotational body 4 in the embodiment is rotationally driven by a drive 5, particularly an electric motor. The axis 3 is suspended in the axial direction on both sides of the rotational body 4 on bearings 6, e.g., rolling bearings, within the housing 2. Each bearing 6 is supported by an end plate 7 fixed on the housing 2.

The apparatus 1 includes, moreover, a rotational directing body 8 with a thin-walled, tube-shaped casing 9 that is disposed concentrically with respect to the rotational body 4 and surrounds it at a radial spacing. This radial spacing is small with respect to the radius of the rotational body 4. In other words, the rotational body 4 and the rotational directing body 8 have only slightly different radii. The rotational directing body 8 is provided on each axial end with an end wall 10. Each end wall 10 centrally supports a bearing 11, particularly a rolling bearing, with which the rotational directing body 8 is supported in a freely rotatable manner on the axis 3. The end walls 10 can be formed if necessary to be solid or can have openings (not shown) that enable a fluid exchange between the interior space and the exterior space of the rotational directing body 8. The end walls 10 alternatively can be formed from spoke-like end wall brackets.

The fluid F is, for example, a liquid coolant, a sealing liquid or any other arbitrary fluid. Regardless of the nature of the fluid F, in the rotationally driven rotational body 4 the fluid F is put into rotation due to friction on the surface of the rotational body 4. After a certain starting time after the apparatus 1 is put into operation, the rotational speed of the fluid F in the immediate vicinity of the rotational body 4 corresponds roughly to the rotational speed of the rotational body 4 at its perimeter, whereas the fluid F in the immediate vicinity of the stationary housing 2 is almost motionless. Due to internal friction, the fluid F draws energy continuously from the apparatus 1 which energy causes (in the form of a power loss) an increase in the rotational power P that must be applied by the drive 5. Rotational power P is used to designate that power which must be applied in order to drive the rotational body 4 at a specified rotational frequency f.

At a sufficiently high rotational frequency of the rotational body 4, a turbulent current profile with highly fluctuating current speeds is formed between the rotational body 4 and the housing 2 within the fluid F. In a conventional apparatus of the type described in the introduction, there exists the relationship $P' \sim f^3$ between the rotational power P and the absolute rotational frequency f. "Conventional" is used here to designate an apparatus which is essentially the same as the apparatus 1 but which does not have its rotational directing body 8.

In the apparatus 1 shown in FIG. 1, in contrast the fluid F is separated into a first region F1 between the rotational body 4 and the rotational directing body 8 and a second region F2 between the rotational directing body 8 and the housing 2. Upon rotation of the rotational body 4, the rotational directing body 8 is put into rotation in the same direction as the rotational body 4 due to the liquid friction. After a certain starting phase, the rotational directing body 8 rotates at a rotational frequency f1 with respect to the stationary housing 2 that is less than the (assumed positive) rotational frequency f of the rotational body 4. In general, $f \geqq f1 \geqq f0 = 0$, where f0 designates the imperceptible rotational frequency of the stationary housing 2 in the present case.

The rotational power P that is required to drive the rotational body 4 of the apparatus 1 at the specified rotational frequency f is reduced with respect to the rotational power P' which would be required to operate a conventional apparatus under corresponding conditions. During operation of the apparatus 1, in each region F1, F2 of the fluid F, a partial power P1 or P2 of the rotational power P is consumed which is dependent on the respective relative frequency of the bodies bordering the regions F1 and F2. More specifically, in the region F1 near the axis of the fluid F the partial power $P1 \sim \Delta f1^3$ is consumed which is dependent on the relative frequency $\Delta f1 = f - f1$ of the rotational body 4 with respect to the rotational directing body 8, whereas in the region F2 away from the axis of the fluid F the partial power $P2 \sim \Delta f2^3$ is consumed which is dependent on the relative frequency $\Delta f2 = f1 - f0 = f1$ of the rotational directing body 8 with respect to the stationary housing 2. Neglecting the bearing friction, $P \approx P1 + P2$. Assuming that the rotational body 4 and the rotational directing body 8 have only a slightly different radius, $P \sim \Delta f1^3 + \Delta f2^3 < f^3$. Otherwise stated, by using the rotational directing body 8, the rotational power P is clearly reduced compared to the conventional case.

The apparatus 1 preferably is configured so that the rotational directing body rotates half as fast as the rotational body 4, corresponding to $f1 = 0.5 \times f$, so that the relative frequencies $\Delta f1$ and $\Delta f2$ between the rotational body 4 and the rotational directing body 8 or the rotational directing body 8 and the housing 2 are equal: $\Delta f1 = \Delta f2 = 0.5 \times f$. In this case, the rotational power $P \sim 2 \times (0.5\ f)^3 = 0.25 \times f^3 \sim 0.25 \times P'$, i.e., only about a fourth of the rotational power P' which would have to be applied without the rotational directing body 8. Due to the bearing friction which was not taken into account in the above numerical example as well as the fact that the rotational body 4 and the rotational directing body 8 have a slightly different diameter, in reality the described reduction in the rotational power is obtained only approximately.

Figure 2:
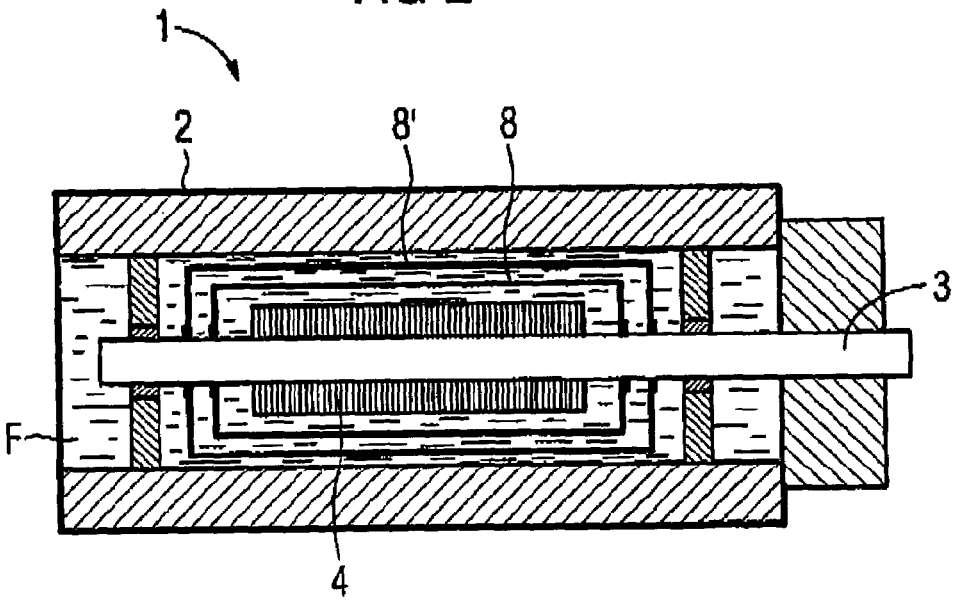
FIG. 2 shows in a representation according to FIG. 1, an alternative embodiment of the inventive apparatus with two rotational directing bodies disposed coaxially to one another.

An alternative embodiment of the apparatus 1 according to FIG. 2 differs from the exemplary embodiment shown in FIG. 1 in that two rotational directing bodies 8 and 8' arranged coaxially in one another are provided. Both rotational directing bodies 8 and 8' are supported in the manner described above so as to be freely rotatably on the axis 3 and are surrounded on all sides by fluid F. During operation of the apparatus 1, due to the fluid friction the inner rotational directing body 8 rotates at a rotational frequency which lies in terms of its magnitude between the rotational frequency of the rotational body 4 and the outer rotational directing body 8'. The outer rotational directing body 8' rotates at a rotational frequency which in terms of magnitude is between the rotational frequency of the inner rotational directing body 8 and the rotational frequency (which is zero in the present case) of the stationary housing 2. Due to the comparatively small relative rotational frequencies between the bordering bodies 4, 8 and 8' or rather the housing 2, the total rotational power is further reduced in comparison to the exemplary embodiment shown in FIG. 1.

Figure 3:
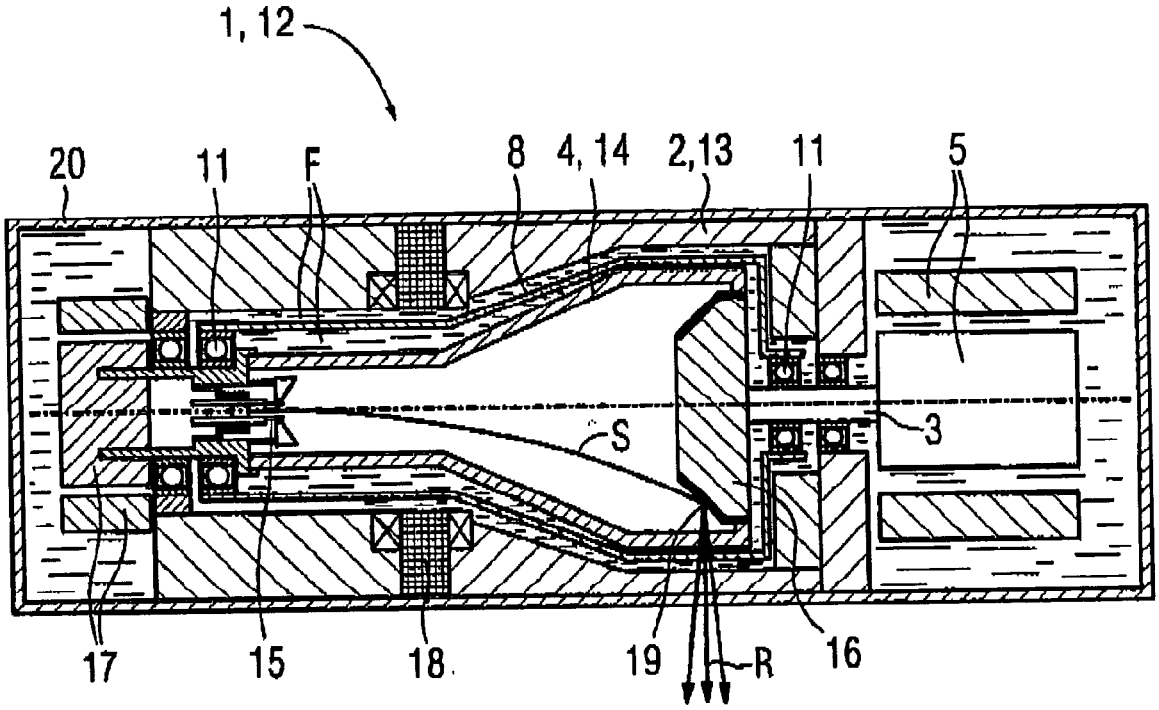
FIG. 3: is a schematic longitudinal section of an embodiment of the apparatus as an X-ray radiator with a rotationally driven vacuum tube in a coolant housing, as the rotational body.

The apparatus 1 shown in FIG. 1 is independent of any specific application purpose. An X-ray radiator 12 is shown in FIG. 3. The fluid-filled housing 2 of the X-ray radiator 12 is designated hereafter as a coolant housing 13. The coolant housing 13 contains a vacuum tube 14 that is rotationally driven about an axis 3 by a drive 5 as rotational body 4. The space formed between the coolant housing 13 and the vacuum tube 14 is filled with a fluid F, e.g., in the form of an insulating oil, which is used to cool the vacuum tube 14 and for electrical insulation purposes. The vacuum tube 14 is surrounded at a small radial distance by a thin-walled rotational directing body 8 that is freely rotatably supported coaxially with the vacuum tube 14 by means of bearings 11 in the axial direction on both sides of the vacuum tube 14 on the axis 3.

The X-ray radiator 12 according to FIG. 3 is a type known as a rotating piston radiator in which the vacuum tube 14 contains a cathode 15 that is fixedly installed therein as well as an anode 16 that is fixedly installed therein. During operation of the X-ray radiator 12, the vacuum tube is put into fast rotation about the axis 3 along with the cathode 15 and the anode 16. Simultaneously, between the cathode 15 and the anode 16, a high electrical voltage is applied and the cathode 15 is heated using a heating current. The cathode 15 is supplied with current via a heating current transformer 17.

The heating of the cathode 15 leads to an emission of electrons from the cathode 15, which are accelerated by the influence of the high voltage to form an electron beam S propagating in the direction of the anode 16. To avoid a focal spot that is stationary with respect to the anode 16, a magnetic deflection system 18, which is joined to the coolant housing 13 in a rotationally fixed manner, is provided. The deflection system 18 is arranged in the axial direction about in the center between the cathode 15 and the anode 16. Under the influence of the magnetic field produced by the deflection system 18, the electron beam S is deflected along a spatially fixed direction laterally out of the axis 3 and strikes at a radial distance from the axis 3 on the rotating anode 16. Due to the rotation of the anode 16 with respect to the spatially stationary electron beam S, the focal spot 19, i.e., the point at which the electron beam S strikes the anode 16, moves along a circular path over the anode surface 16. Upon incidence of the accelerated electron beam S on the anode surface, in a known manner X-ray radiation R is produced which is emitted preferably in the radial direction and exits the coolant housing 13 through radiation windows (not shown in greater detail) nearly unattenuated. In order to suppress the emission of undesired radiation, the coolant housing 13 is accommodated in turn in a radiation protection housing 20 which is provided with a material that highly attenuates X-ray radiation, particularly lead. Moreover, the rotational directing body 8 of the X-ray radiator 12 also is coated, at least in regions in which radiation emission is undesired, with a material that attenuates radiation.

If necessary, the X-ray radiator 12 also can be equipped with a number of rotational directing bodies analogous to FIG. 2.

Although modifications and changes may be suggested by those skilled in the art, it is the intention of the inventors to embody within the patent warranted hereon all changes and modifications as reasonably and properly come within the scope of their contribution to the art.

We claim as our invention:

1. An apparatus comprising:

a fluid-filled housing;

a rotational body rotationally mounted in said fluid-filled housing for driven rotation in said fluid-filled housing; and a non-driven rotational directing body unrestrictively rotatably mounted in said fluid-filled housing co-axially with respect to said rotational body for rotating at an intermediate rotational frequency with respect to said fluid-filled housing and with respect to said rotational body.

2. An apparatus as claimed in claim 1 wherein said rotational directing body is freely rotatably mounted in said fluid-filled housing.

3. An apparatus as claimed in claim 1 wherein said rotational body has an exterior, and wherein said rotational directing body comprises a tubular casing surrounding said exterior of said rotationally body at a spacing from said exterior of said rotational body.

4. An apparatus as claimed in claim 3 wherein said rotational body rotates around a rotational axis, and wherein said rotational directing body is mounted in said fluid-filled housing at both sides of said rotational body on said rotational axis.

5. An apparatus as claimed in claim 3 wherein said rotational body has a radius, and wherein said spacing is substantially smaller than said radius.

6. An apparatus as claimed in claim 3 wherein said rotational directing body has a radius, and wherein said spacing is substantially smaller than said radius.

7. An apparatus as claimed in claim 1 comprising at least one further rotational directing body rotatably mounted in said fluid-filled housing between said rotational directing body and said fluid-filled housing, said at least one further rotational directing body rotating at a rotational frequency that is intermediate with respect to said rotational directing body and said fluid-filled housing.

8. An x-ray radiator comprising:

a coolant-filled housing;

an x-ray tube rotatably mounted in said coolant-filled housing for driven rotation in said coolant-filled housing; and a non-driven rotational directing body unrestrictively rotatably mounted in said coolant-filled housing co-axially with said x-ray tube, and rotating at an intermediate rotational frequency with respect to said coolant-filled housing and with respect to said x-ray tube.

9. An x-ray radiator as claimed in claim 8 wherein said rotational directing body is freely rotatably mounted in said coolant-filled housing.

10. An x-ray radiator as claimed in claim 8 wherein said x-ray tube has an exterior, and wherein said rotational directing body comprises a tubular casing surrounding said exterior of said x-ray tube at a spacing from said exterior.

11. An x-ray radiator as claimed in claim 10 wherein said x-ray tube has a rotational axis, and wherein said rotational directing body is mounted in said coolant-filled housing at both sides of said x-ray tube on said axis.

12. An x-ray radiator as claimed in claim 10 wherein said x-ray tube has a radius, and wherein said spacing is substantially smaller than said radius.

13. An x-ray radiator as claimed in claim 10 wherein said rotational directing body has a radius, and wherein said spacing is substantially smaller than said radius.

14. An x-ray radiator as claimed in claim 8 comprising radiation protection material covering at least a portion of said rotational directing body.

* * * * *